US008733457B1

(12) United States Patent
Comstock et al.

(10) Patent No.: US 8,733,457 B1
(45) Date of Patent: May 27, 2014

(54) METHOD AND APPARATUS FOR AXIALLY DISPLACING COILED TUBING WHILE MINIMIZING FATIGUE

(71) Applicants: Joshua Comstock, Houston, TX (US); Brandon Simmons, Kingsville, TX (US)

(72) Inventors: Joshua Comstock, Houston, TX (US); Brandon Simmons, Kingsville, TX (US)

(73) Assignee: C&J Spec-Rent Services, Inc., Houston, TX (US)

( * ) Notice: Subject to any disclaimer, the term of this patent is extended or adjusted under 35 U.S.C. 154(b) by 0 days.

(21) Appl. No.: 14/018,093

(22) Filed: Sep. 4, 2013

(51) Int. Cl.
*E21B 19/22* (2006.01)
*E21B 33/068* (2006.01)

(52) U.S. Cl.
CPC ..... *E21B 19/22* (2013.01); *E21B 33/068* (2013.01)
USPC ..... 166/382; 166/77.2; 166/77.3; 166/77.4

(58) Field of Classification Search
USPC ..... 166/381, 382, 77.2, 77.3, 77.4
See application file for complete search history.

(56) References Cited

U.S. PATENT DOCUMENTS 5,180,012 A * 1/1993 Crawford ..... 166/301
5,845,708 A * 12/1998 Burge et al. ..... 166/77.3
6,347,664 B1 2/2002 Perio, Jr.
6,457,534 B1 10/2002 Rolovic et al.

OTHER PUBLICATIONS

Maurer Engineering Inc.; "Coiled-Tubing Fatigue Model (CTLIFE2)/ Theory and User's Manual/ DEA-67, Phase II"; Drilling Engineering Associates DEA-67,Project to Develop and Evaluate Coiled-Tubing and Slim-Hole; Oct. 1996; 62 pages; Houston, Texas.
Steven M. Tipton; "The Achilles Fatigue Model"; Tech Notes; May 19, 1999; p. 1-15; CTES, L.C.; Conroe, Texas.

* cited by examiner

*Primary Examiner* — Cathleen Hutchins
(74) *Attorney, Agent, or Firm* — Greenberg Traurig, LLP; Ross Spencer Garsson

(57) ABSTRACT

A system and method for axially displacing a portion of coiled tubing into and/or out of a wellbore so that the coiled tubing does not incur a fatigue cycle during such axial displacement, such as, but not limited to a translation system located between the wellhead and the injector head base to axially displace the injector head and, therefore, the gripped coiled tubing, away from and toward, the wellhead.

19 Claims, 7 Drawing Sheets

METHOD AND APPARATUS FOR AXIALLY DISPLACING COILED TUBING WHILE MINIMIZING FATIGUE

TECHNICAL FIELD

The present invention is directed to the field of coiled tubing oilfield equipment and methods, and, more particularly, to a method and apparatus for axially displacing coiled tubing while minimizing fatigue.

BACKGROUND OF THE INVENTION

Coiled tubing is widely used in the oil and gas industry for a variety of purposes and applications, including, but not limited to, drilling, completion, and workover operations. For example, coiled tubing may be run into a subterranean well to produce hydrocarbons from the subterranean formation, to fracture or perforate the subterranean formation, to perform well data acquisition, introduce fluids, and to cleanout the wellbore.

Coiled tubing is typically supplied to the oilfield on a large spool or reel that contains is thousands of feet of continuous, relatively thin-walled tubing that typically has an outside diameter between about 1" to 4.5". During use, the tubing is payed or spooled off the reel and onto a device or "gooseneck" that bends and guides the coiled tubing into another device, such as an injector head. The injector head functions to grip the tubing and mechanically force it into, and withdraw it from, the wellbore.

Conventionally, coiled tubing injector heads employ motor driven endless chain loops that are supplied with gripper blocks for creating a strong friction grip against the coiled tubing. As the tubing is fed into the injector head, the gripper blocks press against the coiled tubing, which is mechanically forced thereby into the wellbore as the endless chains of the injector head are turned. The direction of the endless chain loops may be reversed to withdraw the tubing from the wellbore. The coiled tubing is conventionally introduced into the wellbore through a seal, which contains the well pressure as the coiled tubing is introduced or withdrawn.

The coiled tubing injector head is conventionally positioned above the wellhead. In workover operations, for example, the injector head maybe suspended above the wellbore by a crane or other device. A tubing guide may be used to connect the injector head to the wellhead (including, for example, a blowout preventer) at the top of the wellbore to prevent the coiled tubing from buckling or otherwise deforming prior to entering the wellbore.

It is well known that unspooling and re-spooling coiled tubing and running the coiled tubing into and out of a wellbore, causes the coiled tubing to experience a number of bends that may contribute to fatigue crack initiation. For example, in one trip in and out of the well, the coiled tubing may experience at least six different bending events: bending off the reel, onto the gooseneck, off the gooseneck into the injector, then from the injector onto the gooseneck, off the gooseneck toward the reel, and finally rolling back onto the reel itself. The number of fatigue cycles that a bending event causes depends on various factors including the coiled tubing material, the coiled tubing geometry, the pressure, the bending radius, and the current state of fatigue already existing in the coiled tubing.

At some point, repeated bending may initiate a micro fracture that left unchecked can propagate to catastrophic fatigue failure of the coiled tubing. Because failure by fatigue cannot is be predicted with perfect accuracy, operators typically use a reel of coiled tubing to no more than approximately 80% of its estimated useful fatigue life. Thus, the industry tries to count the bending events to which a reel of coiled tubing is subjected.

There are several industry approaches to "counting" the number of bends and unbends, or fatigue cycles, that a spool of coiled tubing experiences during its life. For example, in October 1996, Maurer Engineering, Inc. (Houston, Tex.) published a paper entitled "Coiled-Tubing Fatigue Model (CTLIFE2)/Theory and User's Manual/DEA-67, Phase II," which was distributed at the participants of the Drilling Engineering Association DEA-67, Project to Develop and Evaluate Coiled-Tubing and Slim-Hole Technology, which paper is incorporated herein for all purposes. (A copy of this published paper can presently be found at http://www.bsee.gov/Research-and-Training/Technology-Assessment-and-Research/tarprojects/300-399/300AQ.aspx). In May 19, 1999, Professor Steven M. Tipton of The University of Tulsa published a Tech Note (entitled "The Achilles Fatigue Model") on his Achilles 3.0 fatigue model for the Cerberus coiled tubing modeling software, which Tech Note is incorporated herein for all purposes. (A copy of this Tech Note can presently be found at http://www.google.com/url?sa=t&rct=j&q=&esrc=s&frm=1&source=web&cd=1&cad=rja&ved=0CC0QFjAA&url=http%3A%2F%2Fctes.nov.com%2F-documentation%2Ftechnotes%2FTech%2520Note%2520-Achilles%2520Fatigue%2520Model.pdf&ei=nQzSUab0Jo-XS9ASSqYGoDA&usg=AFQjCNFSJXfzaZQ5_JmmmsqPB2Xb_SQAHg&sig2=O2gQrQ-E0jnSTGrmupyIzA.) Thus, conventional wisdom teaches that a spool of coiled tubing has a finite life that is a function of the number of bend cycles that the coiled tubing is subjected to.

It is desirable, therefore, to reduce the number of bending cycles that a spool of coiled tubing is subjected to during normal use. One approach that has been used to minimize tubing fatigue arising from short movements of the coiled tubing is set forth in U.S. Pat. No. 6,457,534. However, the approach of U.S. Pat. No. 6,457,534 requires raising the coiled tubing off of the gooseneck, which can lead to instability of the coiled tubing string and difficulty in realigning the coiled tubing string back onto the gooseneck.

Accordingly, there is a need for an improved method and apparatus for axially displacing coiled tubing while minimizing fatigue.

SUMMARY OF THE INVENTION

In general, in one aspect, the present invention features a method of moving coiled tubing relative to a wellbore. The method includes locating a coiled tubing displacement system between a wellhead and a coiled tubing reel. At least some of the coiled tubing is reeled on the coiled tubing reel. The method further includes gripping the coiled tubing at a gripped location above the wellhead and adjacent to a substantially unbent section of the coiled tubing. The method further includes energizing the displacement system to move the gripped location relative to the wellhead such that a first portion of the coiled tubing is withdrawn from or inserted into the wellbore without increasing the state of bend of the coiled tubing outside of the wellbore.

Implementations of the invention can include one or more of the following features:

The step of gripping the coiled tubing at a gripped location above the wellhead can include gripping the coiled tubing in an injector head.

The step of moving the gripped location can include displacing the injector head relative to the wellhead.

The coiled tubing displacement system can include a plurality of hydraulic cylinders positioned above the wellhead.

The step of energizing the displacement system can include energizing one or more hydraulic or pneumatic cylinders.

The step of energizing the displacement system to move the gripped location can include moving the gripped location away from the wellhead such that the first portion of the coiled tubing is withdrawn from the wellbore without increasing the state of bend of the coiled tubing outside of the wellbore.

The step of energizing the displacement system to move the gripped location can include moving the gripped location toward the wellhead such that the first portion of the coiled tubing is inserted into the wellbore without increasing the state of bend of the coiled tubing outside of the wellbore.

In general, in another aspect, the present invention features a coiled tubing displacement system. The coiled tubing displacement system includes a displacement system including one or more energizable axial displacement devices configured to extend and retract a predetermined distance. The coiled tubing displacement system further includes a coiled tubing gripping device configured to securely grip a first portion of the coiled tubing above a wellhead and adjacent to a substantially unbent section of coiled tubing. The gripping device is operatively coupled to the displacement system. The displacement system is operable to move a second portion of the coiled tubing relative to the wellhead without further bending of the coiled tubing. The displacement system is operable to extend when moving the second portion of the coiled tubing away from the wellhead without further bending of the coiled tubing. The displacement system is operable to retract when moving the second portion of the coiled tubing toward the wellhead without further bending of the coiled tubing.

Implementations of the invention can include one or more of the following features:

The one or more energizable axial displacement device can include a hydraulic cylinder.

The gripping device can include an injector head.

The displacement system can be coupled to a base plate associated with the injector head.

The displacement system can also be coupled to the wellhead.

The displacement system can be coupled to the wellhead through a guide tube coupled to a blowout preventer.

In general, in another aspect, the present invention features an apparatus for moving a section of coiled tubing relative to a wellhead without further bending of the tubing. The apparatus includes a displacement system having a plurality of fluid cylinders configured to extend and retract a predetermined distance. The displacement system has a first end and a second end. The apparatus further includes a gripping system operable to securely grip a gripped portion of the coiled tubing above the wellhead and adjacent to a substantially unbent portion of the coiled tubing. The first end of the displacement system is coupled to the gripping system. The second end of the displacement system is operably coupled to the wellhead. The is displacement system is operable to extend the fluid cylinders to move the section of the coiled tubing away from the wellhead without further bending the coiled tubing. The displacement system is further operable to retract the fluid cylinders to move the section of the coiled tubing toward the wellhead without further bending the coiled tubing.

There has thus been outlined, rather broadly, the more important features of the invention in order that the detailed description thereof may be better understood, and in order that the present contribution to the art may be better appreciated. There are additional features of the invention that will be described hereinafter.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

Figure 1:
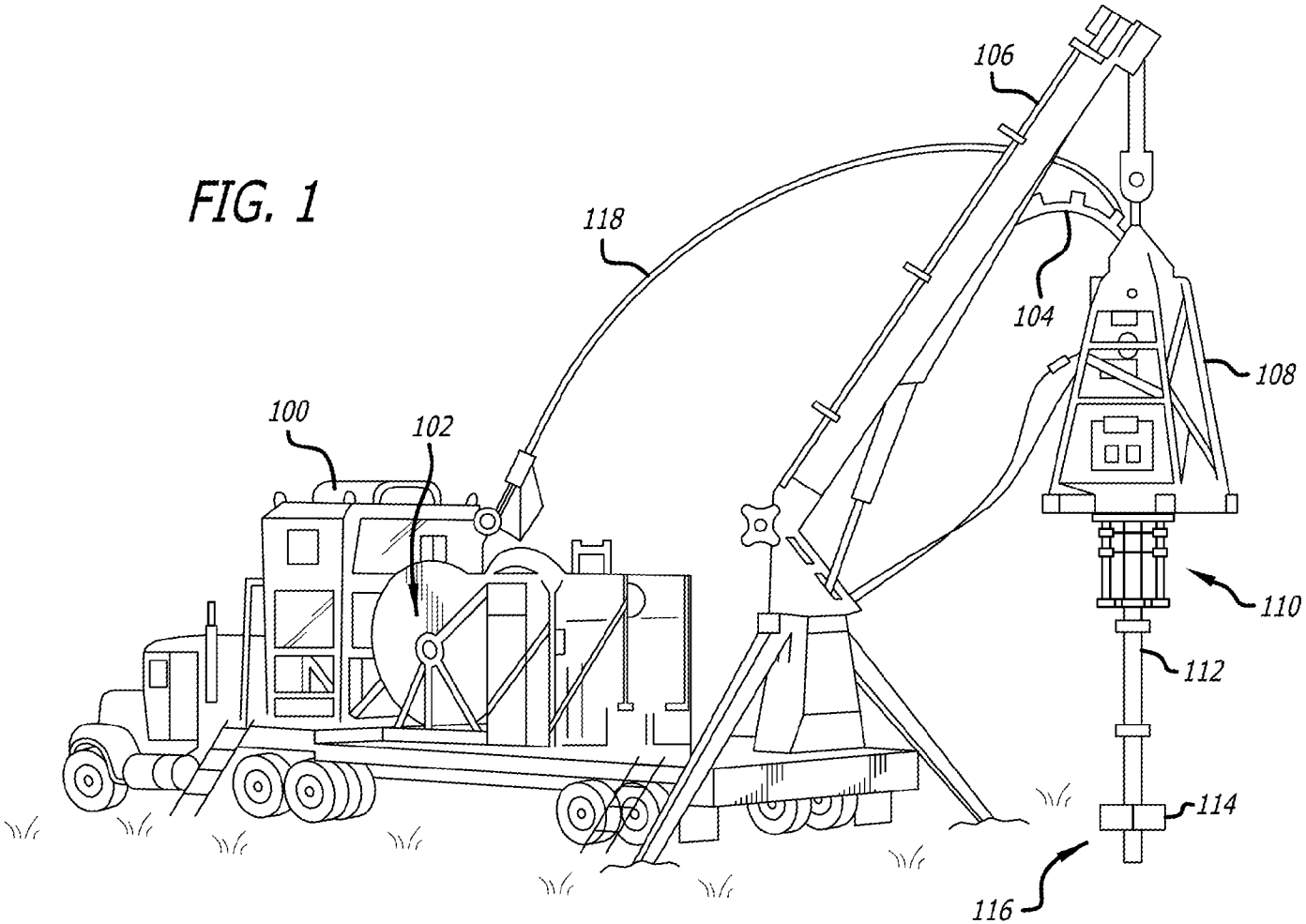
FIG. 1 illustrates an embodiment of the present invention in use.

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. In the description of the embodiments below, it is to be understood that the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims. In addition, all references herein to "bolted," "screwed," "fastened" and the like must be understood to be generic to the concept of "coupling" one member to another, regardless of whether such coupling is rigid or flexible, permanent or removable, and includes without limitation, welding, riveting, and brazing.

DETAILED DESCRIPTION

In general terms, the present invention is a system and method for axially displacing a portion of coiled tubing into and/or out of a wellbore so that the coiled tubing does not incur a fatigue cycle or bend during such axial displacement. The present invention contemplates direct displacement of the coiled tubing without moving the coil injector chains and indirect displacement, such as by displacing associated equipment. For example, one possible is embodiment of the present invention includes a translation system, such as an assembly of hydraulic cylinders, located between the wellhead and the injector head to axially displace the injector head and, therefore, the gripped coiled tubing. It will be appreciated that the present invention is particularly useful at releasing coiled tubing that is stuck downhole by moving the coiled tubing over a limited distance, such as 5 to 20 feet. The repeated movement of the coiled tubing over a limited distance results in a short section of the coiled tubing that has considerably less life than the remaining coiled tubing in the string. The coiled tubing string is typically removed from service when any section of the coiled tubing exceeds 80% of the potential fatigue life. This can lead to the retirement of the entire string of coiled tubing where most of the coiled tubing has over 50% of life remaining while only a short section has used the maximum allowable life.

The present invention can be used to provide such limited displacement to free a stuck tool or tubing without incurring a fatigue cycle as would normally occur without the present invention. The present invention can also be used to provide such limited displacement during a hydraulic milling process (and other milling processes, such as an electrically driven milling process), whereby added control is obtained due to the increased control of the movement of the coiled tubing. Other embodiments may include a translation system coupled to the injector head base for axially displacing the injector head away from and toward the base. The present invention also contemplates an injector head having an integral translation system to axially displace the coiled tubing away from and toward the wellhead.

Coiled Tubing Displacement System

Turning now to a detailed discussion of embodiments of the present invention, FIG. 1 shows a wellbore 116 having a wellhead incorporating normal valves, a blow-out preventer or preventers (such as blow-out preventer 114), and the like that are commonly known in the art. A truck 100 is provided with a reel 102 of coiled tubing 118 positioned thereon. The truck 100 is shown positioned next to a wellbore 116 of the well to be serviced by the coiled tubing. A crane 106 is positioned next to the well. The crane 106 suspends an injector head 108 over the top of the blowout preventer 114. Coiled tubing guide 112 couples the injector head 108 to the is blowout preventer 114 and functions to prevent the coiled tubing from collapsing or buckling before entering the wellbore 116. In operation, a string of coiled tubing 118 is unspooled or payed from reel 102 and run through gooseneck 104, which bends the coiled tubing 118 into the injector head 108. Other equipment commonly known is used, but will not be described herein in the interest of clarity.

The injector head 108 may be of conventional or unconventional design and functions to grip the coiled tubing 118 between motorized endless chain loops and to force the coiled-tubing through tubing guide 112, the blowout preventer 114, and into the wellbore 116 of the well. For example, the injector head 108 can be a conventional injector head, such as that disclosed in U.S. Pat. No. 6,347,664. The design of the injector head must be such that it serves to inject the coiled tubing 118 into and out of the wellbore 116. The various embodiments of the present invention will be described herein with respect to a conventional endless chain system of a conventional injector head although it will be understood that other types of injectors could be substituted as a matter of design choice.

Figure 2:
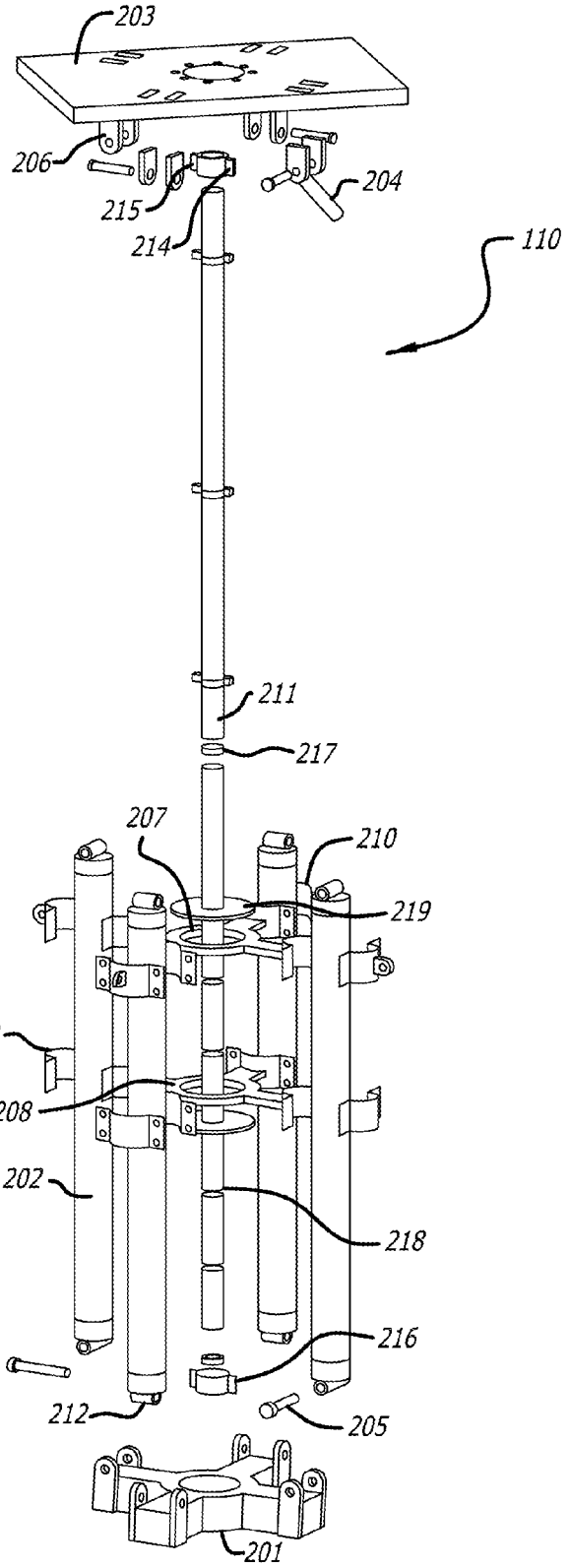
FIG. 2 illustrates an exploded view of an embodiment of the present invention.

Returning attention to FIG. 1, the endless chains of the injector head 108 are typically mounted within a frame that includes a bottom plate that faces the wellbore. The injector head 108 is coupled to an axial translation system 110 that is arranged between the bottom plate of the frame supporting the injector head 108 and the top of the coiled tubing guide 112. In this particular embodiment, the axial translation system 110 comprises four hydraulic cylinders 202 (as shown in FIG. 2) plumbed in parallel that extend to displace or lift the bottom plate of the injector head 108, thus increasing the height of the injector head 108 relative to the top of the wellbore 116. When the coiled tubing string is simultaneously held firmly gripped in the injector head 108, this displacement or translation provided by the hydraulic cylinders 202 will pull the coiled tubing 118 axially from the wellbore 116, but without incurring a fatigue bend in the coiled tubing string.

In contrast, as utilized in the prior art (i.e., in the absence of the present invention), withdrawing coiled tubing from the well would require the injector head 108 to "pull" the coiled tubing 118 from the well and to be re-spooled on the reel 102. The coiled tubing 118 is would be bent as it traverses the gooseneck 104 and bent as it is spooled onto the reel 102.

In the present invention, when withdrawing coiled tubing 118 from the wellbore 116, the crane 106 pulls the injector head 108 upward (generally straight up) while the hydraulic cylinders 202 are engaged to hold the coiled tubing 118. While this is happening only the coiled tubing is raised, i.e., the coiled tubing guide 112 and the rest of the full tubing string (not shown) remains stationary. This is necessary as the crane is not strong enough the support the injector and the full string of tubing in the wellbore. The crane 106 can then be returned to its prior position (i.e., lower down), returning the coiled tubing 118 back to its original position. The import of this is that the coiled tubing 118 can be lifted upwards and downwards without having to move the reel (spooling and unspooling coiled tubing 118) or moving the coiled tubing 118 back and forth in the gooseneck 104.

Accordingly, the present invention allows a portion of the coiled tubing 118 to be removed from the wellbore without incurring a fatigue cycle that would decrease the usable life of the coiled tubing 118. The amount of coiled tubing 118 string withdrawn from the wellbore 116 is, of course, a matter of design choice, but, for example, the translation system 110 can be utilized to displace as much as 6 to 12 feet of coiled tubing 118.

Retracting the cylinders 202 causes the coiled tubing 118 to be run back into the wellbore 116 without incurring a fatigue bend (particular the section at the gooseneck 104 and the portion being spooled and unspooled at reel 102. Thus, the present invention can be used repeatedly to withdraw and re-insert a length of coiled tubing 118 from the wellbore 116 without incurring a life-deceasing fatigue cycle.

The present invention is particularly well suited for coiled tubing applications where the coiled tubing, or an associated tool, may become stuck in the wellbore. Because coiled tubing is often used to intervene in wells that have wellbores that are already blocked, damaged or highly deviated, it is common for the coiled tubing string to get "stuck." Once stuck, the practice is to withdraw the coiled tubing from the wellbore a limited distance (e.g., past the sticking point) and then to re-insert the coiled tubing repeatedly until the coiled tubing gets past the obstruction. Each time the coiled tubing string is withdrawn and re-injected by the injector, is the coiled tubing incurs a fatigue cycle as described above. The present invention allows the coiled tubing string to be withdrawn a limited distance from the wellbore and re-inserted multiple times without incurring a life-shortening fatigue cycle.

Figure 3A:
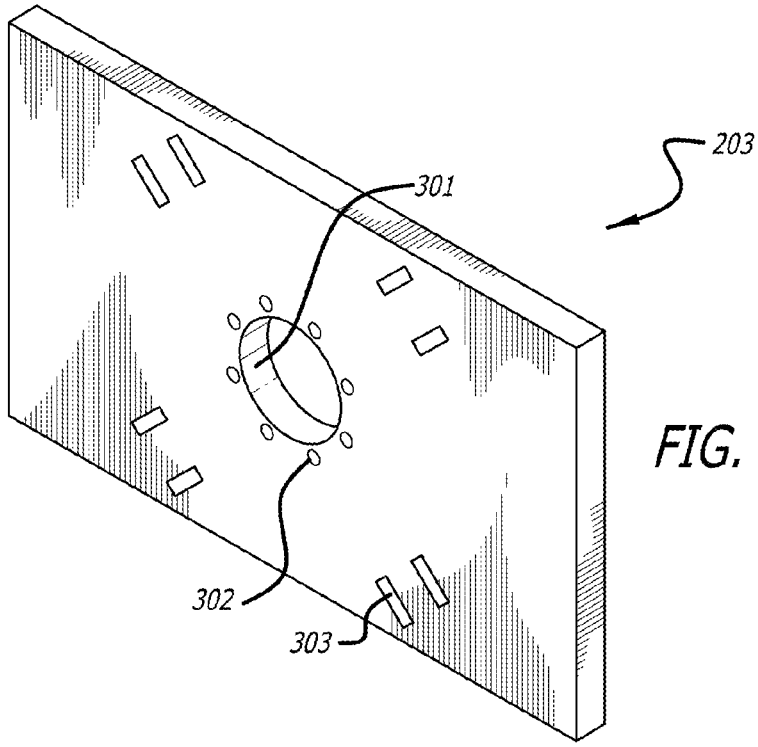
FIG. 3A illustrates a perspective view of a top plate according to an embodiment of the present invention.
Figure 3B:
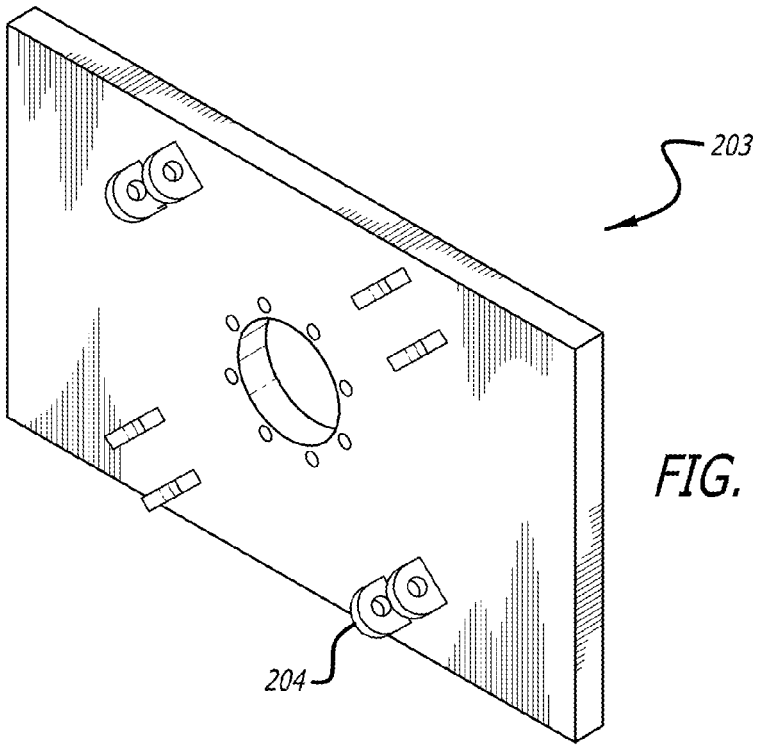
FIG. 3B illustrates a perspective view of the top plate shown in FIG. 3A that includes flanges.
Figure 3C:
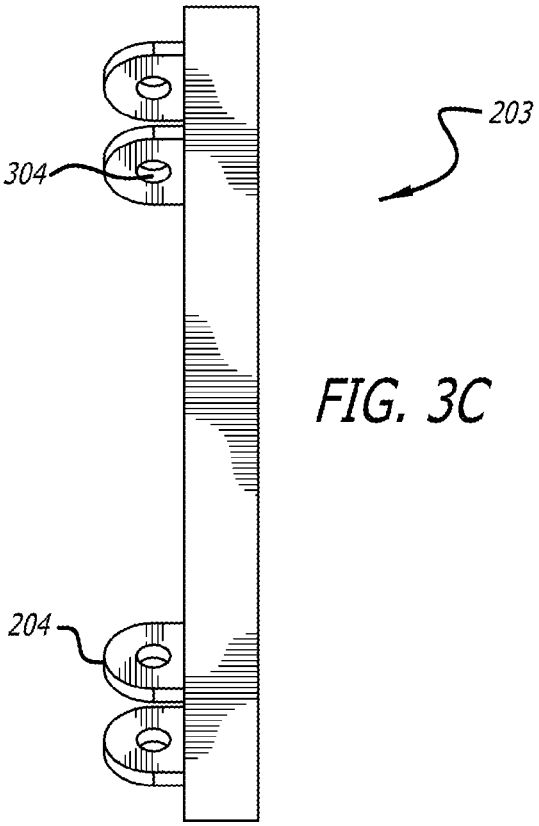
FIG. 3C illustrates a side view of the top plate including flanges depicted in FIG. 3B.

FIG. 2 shows an exploded view of the translation system 110 for the present invention (such as utilized in the system shown in FIG. 1). The translation system 110 includes a top plate 203 that is coupled to the bottom or well side of the injector head 108. The top plate 203 is illustrated in more detail in FIGS. 3A-3C, which depict a perspective view, a perspective view (with a pair of flanges, or "ears," 204), and a side (again with flanges 204, respectively, of the top plate 203. The top plate 203 includes a hole 301 around which are a series of mounting holes 302 drilled around the periphery of hole 301. The mounting holes 302 are provided to allow the top plate 203 to be screwed, bolted or otherwise coupled above (such as to injector head 108). Top plate 203 has slots 303 that can be coupled to the flanges, or "ears," 204. Alternatively, the flanges 204 can be formed integrally with the top plate 203. Holes 304 are provided through the flanges 204 to allow the top plate 203 to be coupled to a plurality of hydraulic cylinders 202 as will be more fully described herein.

Returning to FIG. 2, each of the hydraulic cylinders 202 is connected to the top plate 203 by pins 206. The top of each cylinder is provided with a bushing 210 that aligns axially between the holes drilled in the flanges 204. A pin 206 is then inserted to pass through the holes drilled in flanges 204 and through the bushing 210 on top of the cylinder 202, thereby connecting one end of the cylinder to the top plate 203. The flanges 204 are permanently affixed to the top plate 203. The use of pins 206 through the flanges 204 and bushing 210 creates a hinge-like connection that allows freedom of movement between the cylinders 202 and the plate 203 corresponding to the longitudinal axis of the pins 206.

Figure 4A:
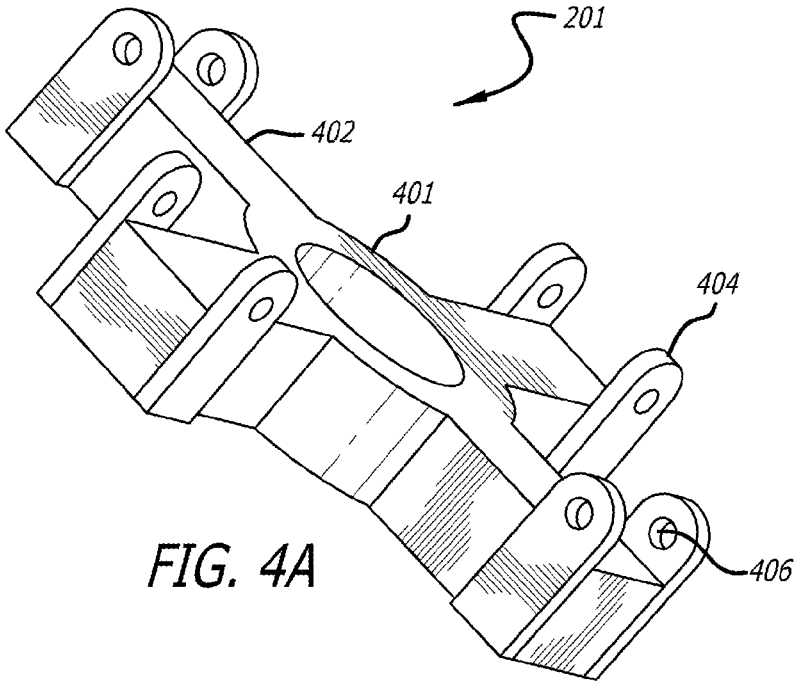
FIG. 4A illustrates a perspective view of a bottom plate according to an embodiment of the present invention.
Figure 4B:
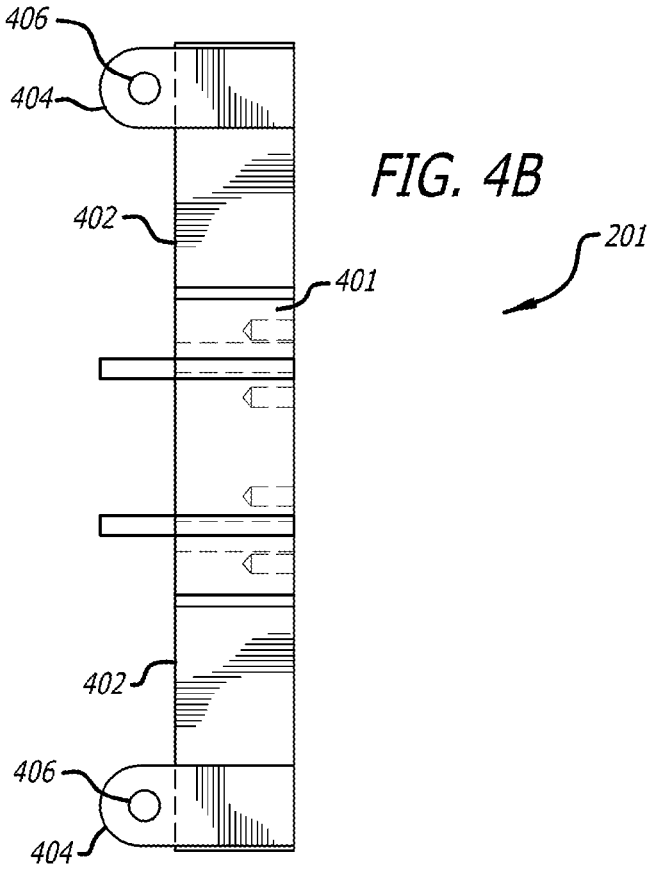
FIG. 4B illustrates a side view of a bottom plate shown in FIG. 4A.
Figure 4C:
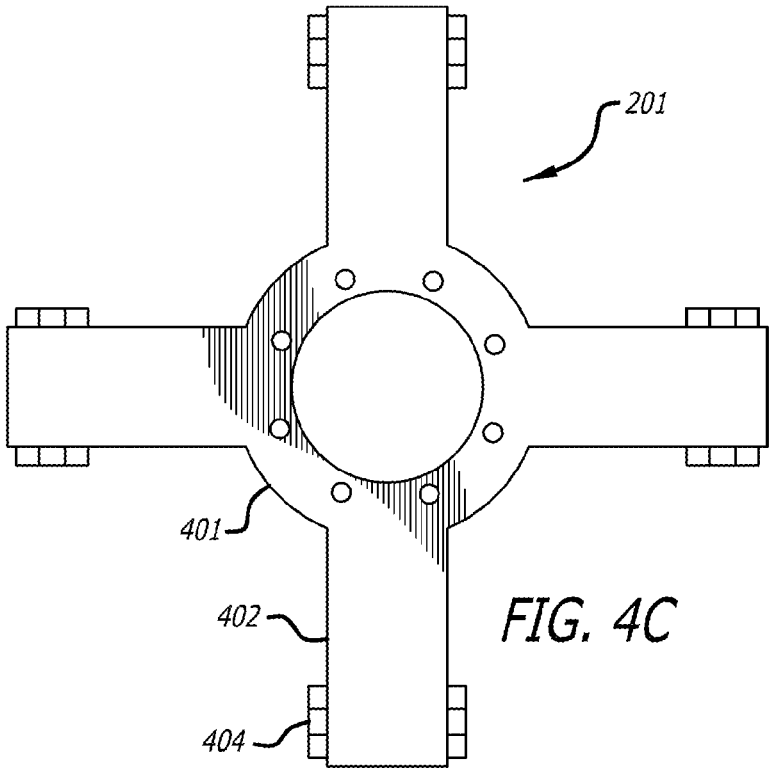
FIG. 4C illustrates a top view of a bottom plate shown in FIG. 4A.

The other end of the hydraulic cylinders 202 is connected to a bottom plate 201, which is shown in more detail in FIGS. 4A-4C. Similar to top plate 213, the bottom plate 201 is connected to the cylinders by means of pins 205.

FIGS. 4A-4C depict a perspective view, side view, and top view, respectively, of the bottom plate 201. In this embodiment of the present invention (shown in FIG. 4), the bottom plate 201 includes a center ring 401 with four arms 402 extending outwardly at ninety degree is intervals. At the end of each arm, a pair of flanges 404 are provided, which have opposing holes 406 drilled therein to receive the bottom pin 205. A bushing 212 is provided at the bottom end of each of the cylinders 202, which is used to connect the bottom end of the cylinders 202 to the bottom plate 201 in the same manner described above regarding the top plate 203.

Returning to FIG. 2, additional stability may be provided to the translation system 110 by providing at least one middle plate 208 that clamps to each of the four cylinders 202. The middle plates can also be referred to as stabilizer plates as they assist in supporting and stabilizing the cylinders 202 and their movement in the translation system 110. Depending on the amount of displacement desired, one or more middle plates can be utilized by the embodiment illustrated in FIG. 2. As shown in the translation system 110 of FIG. 2, there are two stabilizer plates, namely a bottom stabilizer plate 208 and a top stabilizer plate 207.

Figure 5:
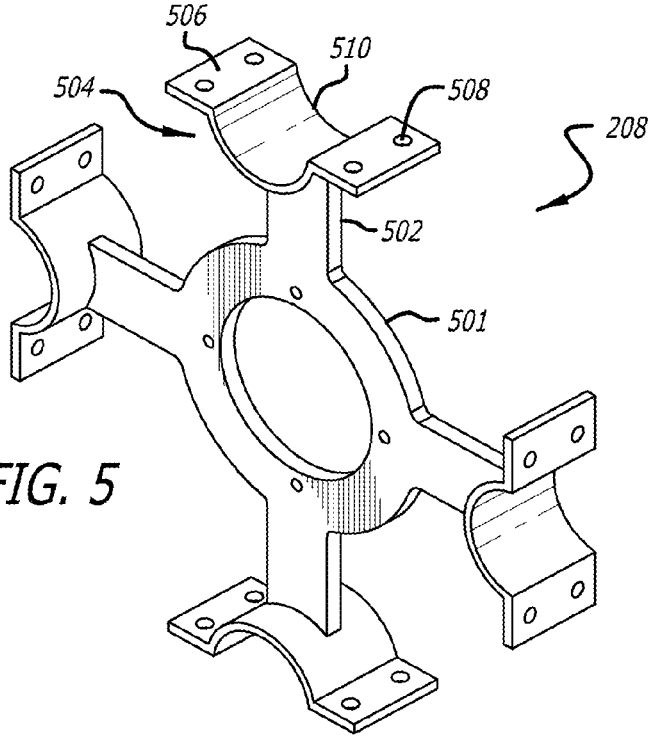
FIG. 5 illustrates a perspective view of a middle plate according to an embodiment of is the present invention.
Figure 6A:
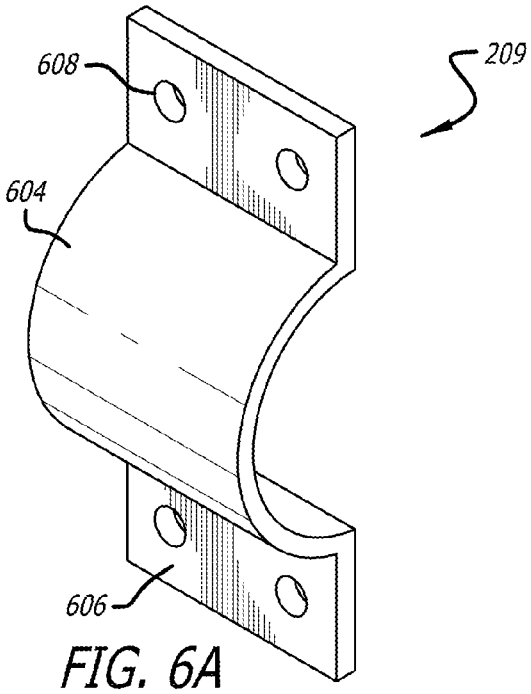
FIG. 6A illustrates a perspective view of a saddle clamp according to an embodiment of the present invention.

FIG. 5 shows a perspective, side, and top view, respectively, of a middle plate 208 according to an embodiment of the invention. In this embodiment, the middle plate 208 includes a central ring 501 with four radially extending arms 502. At the end of each arm is a saddle clamp 504. The saddle clamp 504 is provided with a "saddle" portion 510 having a radius designed to snuggly fit the exterior diameter of cylinders 202. Saddle clamps 504 have holes 508 drilled in their flanges 506 to allow them to be coupled onto the outer saddle clamps 209 depicted in FIG. 6A. As shown in FIG. 6A, the outer saddle clamp 209 also has a "saddle" portion 604 having a radius designed to snuggly fit the exterior diameter of cylinders 202 and flanges 606 (which flanges 606 having holes 606 to allow them to couple to the saddle clamp 504. This allows the middle plate 208 to firmly hold and position the hydraulic cylinders 202.

Figure 6B:
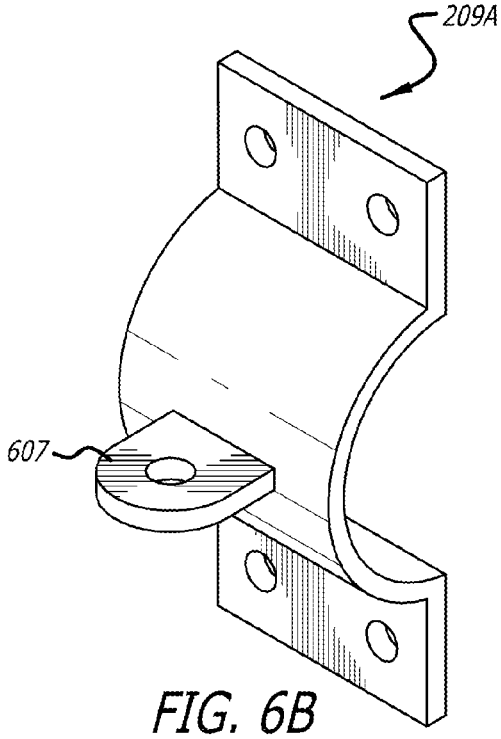
FIG. 6B illustrates a perspective view of an alternative saddle clamp according to an embodiment of the present invention.

FIG. 6B illustrates an alternative outer saddle clamp 209A (that can be used in lieu of outer saddle clamp 209) in which the outer saddle clamp further includes a flange 607.

Again, with reference to FIG. 2, the translation system 110 may also be provided with a coiled tubing guide to protect and prevent the coiled tubing from bending or kinking. In the embodiment shown in FIG. 2, the tubing guide includes a coiled tubing guide tube 211, which is adapted to contain a coiled tubing split guide insert 218 and a coiled tubing split ring 217. By using a split guide insert 218, the translation system 110 is capable of being used for different sized coiled tubing (i.e., coiled tubing with different outer diameters). The coiled tubing split ring 217 can be made of a metal softer than steel, such as brass, because this allows the coiled tubing split ring 217 to guide the coiled tubing 118 with little to no damage.

Additional structural elements of the translation system 110 can include: coiled tubing guide tube nut 214, coiled tubing guide tube nut weld tab 215 (having holes 216), and stabilizer split plate 219.

Figure 7:
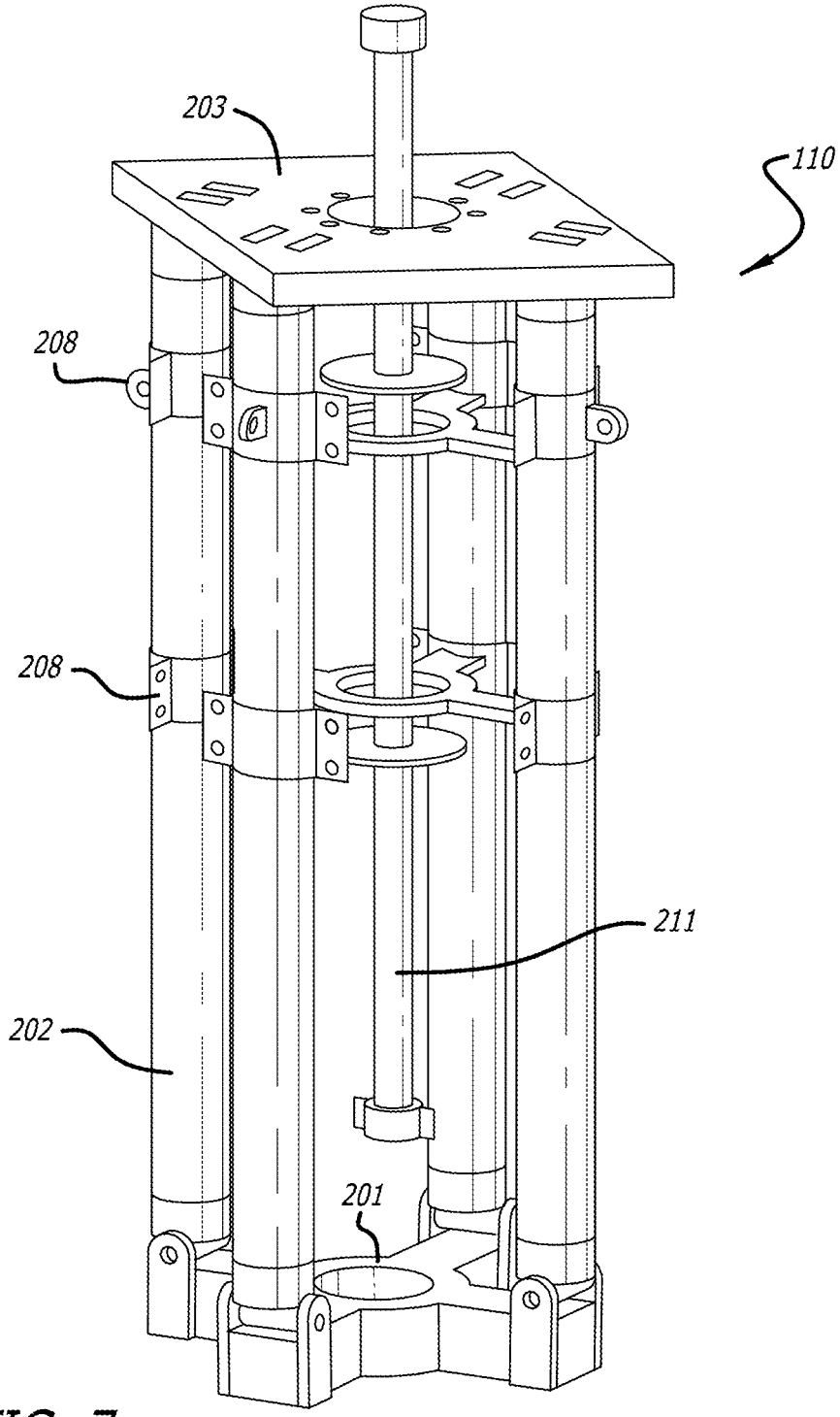
FIG. 7 illustrates a perspective view of an apparatus according to an embodiment of the invention with the top, middle and bottom plates assembled to hydraulic cylinders.

Referring to FIG. 7, FIG. 7 illustrates a perspective of the translation system 110 according to an embodiment of the invention. In this view, the cylinders 202 are retracted. In this embodiment, the translation system 110 includes two middle plates 208. The bottom of the two middle plates 208 is connected to cylinders 202 utilizing outer saddle clamps 209 and the top of the two middle plates 208 is connected to cylinders 202 utilizing outer saddle clamps 209A.

Method for Using Coiled Tubing Displacement System

In general terms, the coiled tubing displacement system of the present invention can be used as follows to move coiled tubing in and out of the wellbore. First, a coiled tubing displacement system is located between a coiled tubing reel and a wellbore. This can be done as shown in FIG. 1, in which coiled tubing is unspooled from the coiled tubing reel, run through the injector head, through the axial translation system, and into the wellbore.

The translation system is then used to grip the coiled tubing at a location (of the coiled tubing) that is above the wellhead and adjacent to a substantially unbent section of the coiled tubing. As noted above, such gripping occurs when the hydraulic cylinders of the translation system are engaged to hold the coiled tubing.

For purposes of orientation, the portion of the coiled tubing that is below the translation system will be referred to herein as the "vertical portion" of the coiled tubing. The portion of the coiled tubing that is spooled on the reel will be referred to herein as the "spooled portion" of the coiled tubing. The other portion of the coiled tubing (that runs from the spooled is portion to the vertical portion of the coiled tubing) shall be referred to as the "curved portion" of the coiled tubing.

Before the hydraulic cylinders of the translation system are engaged (to hold the coiled tubing), the weight of the coiled tubing is borne by the reel and/or by a brake on the reel. Such a break is shown, for example, in U.S. Pat. No. 6,457,534 in FIG. 3 (levelwind break 83). In such circumstance, the full weight of the vertical portion of the coiled tubing is being held by the curved portion of the coiled tubing, which means that forces on the curve portion are in a combination of vertical and horizontal directions, depending upon the orientation of the coiled tubing along the curved portion.

When the cylinders of the translation system are engaged in embodiments of the present invention, the weight of the vertical portion of the coiled tubing is now being borne by the translation system (and the injector head which upon which the translation system is mounted or otherwise operatively coupled).

The displacement system is then energized to move the gripped location away from the wellhead such that a top section of the vertical portion of the coiled tubing is withdrawn from the wellbore. Such energizing can be using the hydraulic (or pneumatic) cylinders. Such movement of the vertical portion of the coiled tubing occurs without increasing the state of bend of the coiled tubing outside of the wellbore.

Additionally, the displacement system can be energized to move the gripped location toward the wellhead to reinsert the top section of the vertical portion of the coiled tubing back into the wellbore. Again, such movement of the vertical portion of the coiled tubing occurs without increasing the state of bend of the coiled tubing outside of the wellbore.

Uses

Embodiments of the present invention can be utilized in conjunction with any operation involving coiled tubing that is inserted and removed from a wellbore, particularly when the uses involve repeated movements of the coiled tubing up and down in the wellbore for relatively short distances.

For example, embodiments of the present invention can be utilized in a hydraulic is milling process in which the coiled tubing is used to hydraulically mill plugs downhole. By using the embodiment, the displacement system can make very fine movements of the coiled tubing allowing it to mill faster and more efficiently, while significantly reducing the fatigue on the coiled tubing string.

The present invention reduces fatigue by eliminating short distant cycling of the coiled tubing when used during operations (such as milling processes). This is achieved by using the hydraulic or pneumatic cylinders to more the vertical portion of the coiled tubing up and down, without a load or movement on the curved portion of the coiled tubing or spooling and unspooling of the coil tubing on the reel.

The embodiments of the present invention can also be used for operations such as fishing, drilling (horizontal and/or vertical), and jetting.

Example

An embodiment of the present invention, similar to the embodiment shown in the figures was utilized on a test well. A plug was inserted into the test well, and the coiled tubing was then utilized to hydraulic mill the plug. The use of the device reduced significantly the fatigue of the coiled tubing. Additional and surprising benefits were also discovered during these testing.

Use of the device allowed for very fine control while milling out the plug. Typically, while milling out plugs near the surface, it is common for the drilling motors to stall as the coarseness of control in advancement of the coiled tubing string tends to result in a stabbing motion of the motor to the plug causing it to stall repeatedly. This, in turn, results in removal of the plug more through chipping away at it than actually milling through it. The present invention allowed for a very fine control while advancing the motor, similar to what is achieved in a drill press. A further result of this is that the plugs end up generally being drilled out in smaller parts, rather than chunks, which leads to less clogging of the hydraulic chokes at the surface. Because of this, the operation went much quicker, efficiently, and with less wear and tear on the coiled tubing and the other equipment.

The present invention significantly reduced and minimize the side loading of the reel and the wellhead (including the BOP). Typically, coil tubing operations are performed with backpressure (tension) on the reel in order to ensure that the coil tubing remains coiled, which in turn leads to side loading. This, in turn, can lead to premature failure of the ring gasket above the BOP. The present invention allows the coil tubing string to be locked in place during use (such as in the tested milling operations), thereby reducing the side load on these components and, also, the rate of failure for the ring gaskets above the BOP.

For instance, the device described and disclosed in U.S. Pat. No. 6,457,534 applies a brake at the reel and then moves the portion of the coiled tubing between the reel and the wellhead up and down to move the coiled tubing. Hence, during this movement, there is significant strain on this portion (between the reel and the wellhead) this portion of the coiled tubing is flexed back and forth. The combination of this flexing and significant load in a varying direction (having ever-changing vertical and horizontal components) serves to fatigue the portion of the coiled tubing.

It will be understood by those skilled in the art that when hydraulic pressure is applied to the cylinders 202, they extend longitudinally thereby increasing the distance between top plate 203 and bottom plate 201. In this embodiment, it is to be understood that the endless chains, or other gripping mechanisms used in injector head, are contained in a frame that has the bottom plate 201. When the top plate 203 of the present invention lifts on the bottom plate 201, the endless chains are lifted as well.

The foregoing description is of a presently preferred embodiment. Those of skill in this art having read this disclosure will appreciate that the invention described herein can be implemented in many other embodiments, manners and methods. For example, the specific implementation may be dependent on the design and functioning of the injector head. Several other embodiments are currently contemplated, such as locating the translation system between an injector head base plate and the injector frame. In this type of implementation, axial movement occurs between the injector head base plate and the injector head. It is also contemplated that an axial translation system may be built integrally with the injector head. For example, the gripping mechanism within the injector head may be coupled to an integral translation system. It will be appreciated that the stroke or axial movement of such integral is system may be limited and, if so, and integral translation system may be combined with an external system, such as that system described above or with reference to FIGS. 1-7.

It will also be appreciated that a passive translation system may be employed in which a crane or other external lifting device is used to provide axial movement along passive guide rails associated with, for example, the injector head.

In other embodiments of the invention, a coiled tubing gripping mechanism other than the injector head may be used. For example, in addition to an injector head, a separate gripping/un-gripping device may be provided at a suitable location such that axial displacement of the gripping device relative to the wellhead will displace the coiled tubing without incurring a fatigue cycle.

While the presently preferred embodiment of the invention described above utilizes four (4) hydraulic cylinders, it will be understood that any number and/or type of displacement or translation device may be utilized, including, without limitation, pneumatic cylinders, mechanical screws or jacks, linear motors, electric screws or jacks, combinations of any of these, and the like.

Although not depicted in the drawings, those of skill in this art having the benefit of this disclosure will appreciate that the embodiment of FIGS. 1-7 may also includes a control system configured, at a minimum, to energize the hydraulic cylinders to extend and retract. The control system can be a manual system, such as a system of manually activated valves and gages; a semi-automated system utilizing logic controllers or microprocessors; or a fully automated control system, as desired or required. It is preferred that the control system be integrated with or communicate with, either uni- or bi-directionally, the other control systems in use, such as, without limitation, the injector head control system and/or the blow out preventer control system. The control system may also be integrated with or communicate with the fatigue life modeling software being utilized for the coiled tubing in use.

Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited is to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms and are not restricted to the specific figures and words used herein.

The disclosures of all patents, patent applications, and publications cited herein are hereby incorporated herein by reference in their entirety, to the extent that they provide exemplary, procedural, or other details supplementary to those set forth herein.

What is claimed is:

1. A method of moving coiled tubing relative to a wellbore during operation of an application using the coiled tubing, wherein the method comprises:

(a) locating a coiled tubing displacement system between a wellhead and a coiled tubing reel, wherein at least some of the coiled tubing is reeled on the coiled tubing reel;

(b) running an end of the coiled tubing to a downhole position at which operation of the application will occur; and (c) operating the application using the coiled tubing, wherein during the step of operating the application (i) gripping the coiled tubing at a gripped location above the wellhead and adjacent to a substantially unbent section of the coiled tubing, (ii) energizing the displacement system to move the gripped location relative to the wellhead such that a first portion of the coiled tubing is repeatedly withdrawn from and inserted into the wellbore without increasing the state of bend of the coiled tubing outside of the wellbore, (iii) the end of the coiled tubing repeatedly moves up and down at the downhole position while the first portion of the coiled tubing is repeatedly withdrawn from and inserted into the wellbore.

2. The method of claim 1, wherein the step of gripping the coiled tubing at a gripped location above the wellhead comprises gripping the coiled tubing in an injector head.

3. The method of claim 2, wherein the step of moving the gripped location comprises displacing the injector head relative to the wellhead.

4. The method of claim 1, wherein the coiled tubing displacement system comprises a plurality of hydraulic cylinders positioned above the wellhead.

5. The method of claim 4, wherein the step of energizing the displacement system comprises energizing one or more hydraulic or pneumatic cylinders.

6. The method of claim 1, wherein the step of energizing the displacement system to move the gripped location comprises moving the gripped location away from the wellhead such that the first portion of the coiled tubing is withdrawn from the wellbore without increasing the state of bend of the coiled tubing outside of the wellbore.

7. The method of claim 1, wherein the step of energizing the displacement system to move the gripped location comprises moving the gripped location toward the wellhead such that the first portion of the coiled tubing is inserted into the wellbore without increasing the state of bend of the coiled tubing outside of the wellbore.

8. The method of claim 1, wherein the operation is selected from the group consisting of drilling operations, completion operations, and workover operations.

9. The method of claim 1, wherein the operation is selected from the group consisting of producing hydrocarbons, fracture formation, perforate formation, perform well data acquisition, introduce fluids, cleanout the wellbore, fishing, drilling, and jetting.

10. The method of claim 1, wherein the operation is a milling process.

11. The method of claim 10, wherein the milling process is selected from the group consisting of hydraulic milling processes and electrically driven milling processes.

12. The method of claim 1, wherein (a) a tool is connected to the end of the coiled tubing, and (b) the step of operating the application comprises using the coiled tubing and the tool.

13. The method of claim 1, wherein the end of the coiled tubing is repeatedly moved up and down over a distance between 5 and 20 feet.

14. A method of releasing coiled tubing that is stuck downhole in a wellbore, wherein the method comprises:

(a) locating a coiled tubing displacement system between a wellhead and a coiled tubing reel, wherein (i) at least some of the coiled tubing is reeled on the coiled tubing reel, and (ii) an end of the coiled tubing is struck at a downhole position in the wellbore;

(b) gripping the coiled tubing at a gripped location above the wellhead and adjacent to a substantially unbent section of the coiled tubing;

(c) energizing the displacement system to move the gripped location relative to the wellhead such that a first portion of the coiled tubing is repeatedly withdrawn from and inserted into the wellbore without increasing the state of bend of the coiled tubing outside of the wellbore, wherein the end of the coiled tubing is released from being stuck downhole due to the repeatedly movement up and down at the downhole position while the first portion of the coiled tubing is repeatedly withdrawn from and inserted into the wellbore.

15. The method of claim 14, wherein (a) a tool is connect to the end of the coiled tubing, and (b) the end of the coiled tubing is struck in the downhole position due to the tool being stuck in the wellbore.

16. The method of claim 14, wherein the end of the coiled tubing is repeatedly moved up and down over a distance between 5 and 20 feet.

17. A method of moving coiled tubing past a downhole obstruction in a wellbore, wherein the method comprises:

(a) locating a coiled tubing displacement system between a wellhead and a coiled tubing reel, wherein at least some of the coiled tubing is reeled on the coiled tubing reel;

(b) running an end of the coiled tubing downhole to the downhole obstruction;

(c) gripping the coiled tubing at a gripped location above the wellhead and adjacent to a substantially unbent section of the coiled tubing; and (d) energizing the displacement system to move the gripped location relative to the wellhead such that a first portion of the coiled tubing is repeatedly withdrawn from and inserted into the wellbore without increasing the state of bend of the coiled tubing outside of the wellbore, wherein the end of the coiled tubing gets passed the downhole obstruction due to the repeatedly movement up and down of the end of the coiled tubing while the first portion of the coiled tubing is repeatedly withdrawn from and inserted into the wellbore.

18. The method of claim 17, wherein the obstruction is selected from the group consisting of blocked portions of the wellbore, damaged portions of the wellbore, and deviated portions of the wellbore.

19. The method of claim 17, wherein the end of the coiled tubing is repeatedly moved up and down over a distance between 5 and 20 feet.

* * * * *